US005706847A

United States Patent [19]

Strait et al.

[11] Patent Number: 5,706,847

[45] Date of Patent: Jan. 13, 1998

[54] QUICK REPLACEMENT SPARK PLUG ASSEMBLY

[76] Inventors: William P. Strait, 103 Sea Steppes Ct., Jupiter, Fla. 33477; Gordon Ripma, 4 Coconut La., Tequesta, Fla. 33469

[21] Appl. No.: 749,334

[22] Filed: Nov. 14, 1996

[51] Int. Cl.[6] ..... H01T 13/08

[52] U.S. Cl. ..... 123/169 PA; 313/135; 123/169 R

[58] Field of Search ..... 123/169 PA, 169 PH, 123/169 R, 169 CB; 313/135, 148

[56] References Cited

U.S. PATENT DOCUMENTS

| | | | |
|---|---|---|---|
| 3,162,470 | 12/1964 | Davidson | 285/86 |
| 3,747,583 | 7/1973 | Spengler | 123/32 |
| 5,186,132 | 2/1993 | Runge | 123/169 |

OTHER PUBLICATIONS

Swagelok Quick–Connect Co. Zcatalog pp. QC–590–3 Jul. 1993.

*Primary Examiner*—Andrew M. Dolinar
*Assistant Examiner*—Hieu T. Vo
*Attorney, Agent, or Firm*—Alvin S. Blum

[57] ABSTRACT

An arrangement for easily and rapidly replacing a spark plug in a bore of a cylinder head includes a conductive cylindrical body that screws into the bore. It has a tapered internal passage that receives a replaceable plug with a tapered metal outer surface. A resilient sealing ring retained by the plug seals gas tight against the inner passage. An annular groove on the outer surface of the plug receives groove engaging elements or balls mounted in the body to lock the plug securely in position. A sliding locking sleeve surrounds the groove engaging elements and prevents the elements from moving out of the groove in a locked position. The sleeve may be manually reciprocated to an unlocked position in which the elements are free to move out of the groove so that the plug may be easily replaced. A spring biases the sleeve to the locked position.

8 Claims, 1 Drawing Sheet

4
1
3
23
22
6
24
2
7
9
8
12
30
5
11
10

13
21
28
27

13
21
7
28
27

33
34
32
25
29

33
26
13
32
21
29
19
15
31
28
14
17
18
20
27

32
34
25
26
33
29

QUICK REPLACEMENT SPARK PLUG ASSEMBLY

FIELD OF THE INVENTION

The present invention relates to spark plugs for internal combustion engines and more particularly to spark plugs that may be more rapidly and easily replaced.

BACKGROUND OF THE INVENTION

Ordinary spark plugs have an external thread on a metal outer shell with a hexigonal head. They seat in a threaded bore of the cylinder head with a deformable gasket seal. Complete sealing and correct positioning of the spark in the combustion chamber requires a precise torque. Excessive torque or incorrect positioning may strip the threads in the cylinder head, requiring expense repairs. Space for tools such as a torque wrench is limited in many engine compartments and access is often awkward. All of the problems associated with spark plug replacement are magnified in auto racing competition with engine heat and time constraints added.

U.S. Pat. No. 5,186,132 issued Feb. 16, 1993 to Runge teaches a plug-in spark plug that requires a special bore in the cylinder head with a retaining groove for engaging a locking circlip. It requires some sort of tool fitting in a groove to forcefully pull the plug out and a tool for engaging the circlip to reduce its diameter to disengage it from the retaining groove. It would be desirable to have a system that would operate with conventially bored and threaded cylinder heads, since most consumers don't replace their own plugs and we could not expect the engine manufacturers to provide the special cylinder heads.

U.S. Pat. No. 3,747,583 issued Jul. 24, 1973 to Gerard Georges and Erich Spengler teaches a quick insertion spark plug arrangement in which an outer sleeve screws into the threaded bore in a cylinder head. The sleeve has an inner profile that cooperates with an outer profile of the plug.

In a first rotary position of the plug, it may be moved axially into and out of the sleeve. When the inserted plug is rotated about its axis a finite angle by a special tool, the inner and outer profiles cooperate to lock the position of the plug against axial movement in a threaded engagement.

Quick disconnect couplings for joining conduits for high pressure fluids are exemplified by U.S. Pat. No. 3,162,470 issued Dec. 22, 1964 to Davidson and SWAGELOK (Registered Trademark) full flow quick-connect coupling QF series made by the Swagelok Company of Hudson, Ohio. These use a hand-operated sliding locking sleeve that requires no tool for engagement and disengagement. This style of connection has not been applied to spark plugs.

SUMMARY OF THE INVENTION

It is accordingly an object of the invention to provide a spark plug assembly that enables a user to replace the plug quickly and surely without the use of special tools.

It is another object that the assembly be useable with the conventionally bored and tapped cylinder head.

It is yet another object that the assembly comprise an outer member that screws into the cylinder head and remains in place and an inner, replacable plug member that carries the spark gap and resilient sealing ring for making a gas tight, high pressure seal with the outer member. The outer member includes a sliding outer sleeve and an inner locking body that is provided with an external thread for engaging the threaded bore in the cylinder head. A gasket makes a gas tight joint between the two. The locking body has many transverse apertures in which balls seat so that a portion of the ball protrudes into the inner cylindrical space of the locking body. The plug member is provided with a locking annular groove arranged to receive the protruding portions of the balls to lock the plug member against axial motion. The locking sleeve in a locking position engages the outer tangent of each ball and prevents it from moving out of the annular groove in the plug member. A spring maintains the sleeve in this locking position. The sleeve may be pushed axially against the spring bias to an unlocked position in which the balls are free to move out of the annular groove when the plug is pulled axially.

These and other objects, advantages and features of the invention will become more apparent from the detailed description taken with the drawings, and in which like reference numerals are applied to like elements in the various figures.

DETAILED DESCRIPTION OF PREFERRED EMBODIMENTS

Figures 1, 2, 3, 4, 5, 6:
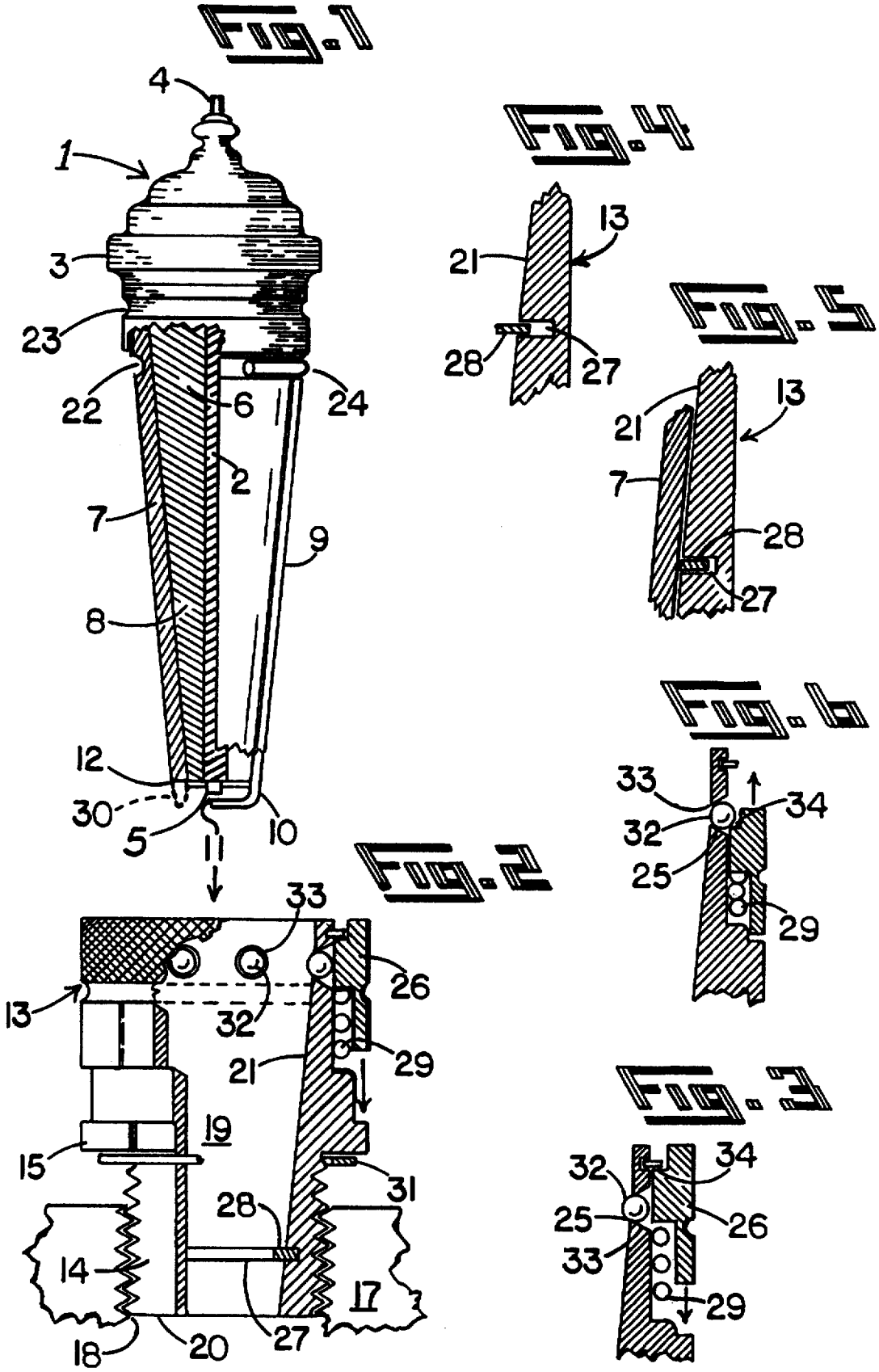
FIG. 1 is a front elevation view of a spark plug of the invention partially broken away.
FIG. 2 is a front elevation view of a cylindrical locking body of the invention partially broken away.
FIG. 3 is a sectional detail view of the sealing and locking mechanism in locked position.
FIG. 4 is a sectional detail view of the electrically conductive spring ring retained in the body groove.
FIG. 5 is a sectional detail view as in FIG. 4 with the plug in place.
FIG. 6 is a sectional view as in FIG. 3 of the unlocked position.

Referring now to the drawings, a spark plug 1 has a ceramic insulator element 6 that is electrically insulating, supporting and surrounding an axial electrode 2, with a top end 4 adapted for conventional connection to an electric source and a lower end 5 for insertion within the combustion chamber of an internal combustion engine. An electrically conductive member 7 encircles the lower portion 8 of the insulator element 6. It has a tapered cylindrical outer surface 9. The bottom end 12 of member 7 is attached to a metal bracket 10 to provide a spark gap 11 of conventional design. Alternatively, as shown in phantom, the lower end of member 7 extends down to the level of the end 5 of the electrode 2 to form the ring electrode 30.

An electrically and thermally conductive cylindrical body 13 has an inner portion 14 that cooperates with a bore 18 in a cylinder head 17, shown in phantom, to form a gas tight and electrically conductive seal. This may be achieved by cooperating internal threads 18 in the bore and external threads 16 on the body 13 in conjunction with a metal gasket 31 as is well known in the art. Alternatively, other means well known in the art such as brazing, welding, and the like may be used to secure the body in position in the cylinder head as desired.

The body 13 has an internal passage 19 with a taper 21 that is narrower at its inner end 20 that corresponds to the external tapered surface 9 of the plug so that the two extended surfaces will be in intimate contact for electrical and thermal conductivity therebetween when the plug is fully inserted in the body.

A circumferential annular first groove 22 in the outer surface 9 of the plug retains a heat-resistant sealing ring 24 which deforms and seals against the tapered surface 21 of the passage 19 in the body.

A circumferential annular second groove 23 in the outer surface of the plug locks the plug in its fully inserted position in body 13 in cooperation with groove engaging means 25 held securely in the outer portion 15 of body 13. The groove engaging means shown comprises a plurality of hard steel balls held in a series of uniformly spaced apart recesses 32 in the outer portion 15 which are open to the outer circumference of the body portion. An aperture 33 on the inner aspect of the recess allows a portion of the ball to protrude therethrough and into the second groove 23, to lock the plug securely in place at a precise position. The balls move freely in and out of the recess in an unlocked operating condition, as illustrated in FIG. 6. A locking sleeve 26 reciprocates between the unlocked position of FIG. 6 and the locked position of FIGS. 3 and 2. In the locked position, a step 34 on the interior aspect of the sleeve holds the balls at their locking position extending into the locking groove 23 in the plug. A compression spring 29 applies spring bias between the sleeve and the body forcing the sleeve to the locked condition.

To remove and replace the plug, the sleeve is simply manually pushed down and plug can be lifted out and replaced without special tools or skills. When the new plug is fully inserted, releasing the sleeve locks the plug securely in place against the combustion forces while the sealing ring 24 provides gas pressure sealing.

To further ensure electrical contact between the cylinder head and the conductive member 7, an annular groove 27 may optionally be provided in the inside surface of passage 19 to receive and retain a metal split spring ring 28 of the type well known in the art. This ring 28, in its relaxed state has a relaxed inside diameter that is less than the outside diameter of plug member 7 against which it will impinge when the plug is fully inserted in the body so that the ring will springably engage member 7. The outside diameter of ring 28 is large enough so that it will be retained in the groove when the plug is removed.

The above disclosed invention has a number of particular features which should preferably be employed in combination although each is useful separately without departure from the scope of the invention. While I have shown and described the preferred embodiments of my invention, it will be understood that the invention may be embodied otherwise than as herein specifically illustrated or described, and that certain changes in the form and arrangement of parts and the specific manner of practicing the invention may be made within the underlying idea or principles of the invention.

What is claimed is:

1. In an internal combustion engine including a cylinder head with at least one threaded bore for receiving an ignition device projecting into a combustion chamber, an arrangement for quick replacement of the ignition device, the arrangement comprising:

a) an electrically and thermally conductive cylindrical body having an inner portion, an outer portion and an external thread on the inner portion that cooperates with a threaded bore in a cylinder head for forming a gas tight seal between the body and the head, the body having an internal passage therethrough with a taper that is smaller at the inner end;

b) a spark plug having an outer surface, an axial electrode with a top end for connection to an electric source and a lower end for engagement with a combustion chamber, an electrically insulating insulator element encircling the axial electrode, and an electrically conductive member encircling the insulator element at the lower portion thereof and having a tapered cylindrical surface corresponding to the internal taper of the body for intimate engagement therewith; a peripheral electrode attached to the member at the bottom end thereof for cooperation with the axial electrode to provide a spark gap;

c) a circumferential first groove in the outer surface of the spark plug, the first groove retaining an annular sealing ring for engaging and sealing gas-tight against the internal taper of the body;

d) a circumferential second groove in the outer surface of the spark plug above the first groove;

e) groove engaging means for moving into the second groove to prevent axial movement of the spark plug when seated in the body, the groove engaging means being mounted on the body at the outer portion and arranged to move in and out of the second groove in a first mode of operation for ease of replacement of the spark plug and to be prevented from moving out of the second groove in a second mode of operation for maintaining the spark gap in a fixed position during combustion; and f) a locking sleeve encircling the body at the upper portion and reciprocating between a locked position in which the sleeve locks the groove engaging means in the second groove for the second mode of operation and an unlocked position for the first mode of operation.

2. The arrangement according to claim 1, further comprising bias means between the locking sleeve and the body for urging the locking sleeve to the second mode of operation.

3. The arrangement according to claim 2 wherein the groove engaging means are a plurality of balls.

4. The arrangement according to claim 3, further comprising an annular groove in the internal passage and an electrically conductive spring ring retained in the annular groove, the spring ring having a relaxed inside dimension that is less than the tapered cylindrical surface of the conductive member against which it impinges when the plug is seated in the body.

5. In an internal combustion engine including a cylinder head with at least one bore for receiving an ignition device projecting into a combustion chamber, an arrangement for quick replacement of the ignition device, the arrangement comprising:

a) an electrically and thermally conductive cylindrical body having an inner portion, an outer portion and an external surface on the inner portion that cooperates with a bore in a cylinder head for forming a gas tight seal between the body and the head, the body having an internal passage therethrough with a taper that is smaller at the inner end;

b) a spark plug having an outer surface, an axial electrode with a top end for connection to an electric source and a lower end for engagement with a combustion chamber, an electrically insulating insulator element encircling the axial electrode, and an electrically conductive member encircling the insulator element at the lower portion thereof and having a tapered cylindrical surface corresponding to the internal taper of the body for intimate engagement therewith; a peripheral electrode attached to the member at the bottom end thereof for cooperation with the axial electrode to provide a spark gap;

c) a circumferential first groove in the outer surface of the spark plug, the first groove retaining an annular sealing ring for engaging and sealing gas-tight against the internal taper of the body;

d) a circumferential second groove in the outer surface of the spark plug above the first groove;

e) groove engaging means for moving into the second groove to prevent axial movement of the spark plug when seated in the body, the groove engaging means being mounted on the body at the outer portion and arranged to move in and out of the second groove in a first mode of operation for ease of replacement of the spark plug and to be prevented from moving out of the second groove in a second mode of operation for maintaining the spark gap in a fixed position during combustion; and f) a locking sleeve encircling the body at the upper portion and reciprocating between a locked position in which the sleeve locks the groove engaging means in the second groove for the second mode of operation and an unlocked position for the first mode of operation.

6. The arrangement according to claim 5, further comprising bias means between the locking sleeve and the body for urging the locking sleeve to the second mode of operation.

7. The arrangement according to claim 6 wherein the groove engaging means are a plurality of balls.

8. The arrangement according to claim 7, further comprising an annular groove in the internal passage and an electrically conductive spring ring retained in the annular groove, the spring ring having a relaxed inside dimension that is less than the tapered cylindrical surface of the conductive member against which it impinges when the plug is seated in the body.

* * * * *